US007365761B2

(12) United States Patent
Min

(10) Patent No.: US 7,365,761 B2
(45) Date of Patent: Apr. 29, 2008

(54) THERMAL PRINTER

(75) Inventor: Byung-sun Min, Pyungtaek-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 451 days.

(21) Appl. No.: 11/182,779

(22) Filed: Jul. 18, 2005

(65) Prior Publication Data

US 2006/0098081 A1 May 11, 2006

(30) Foreign Application Priority Data

Nov. 6, 2004 (KR) ..... 10-2004-0090139

(51) Int. Cl.
*B41J 2/35* (2006.01)

(52) U.S. Cl. ..... 347/211

(58) Field of Classification Search ..... 347/171, 347/172, 175, 176, 185, 188, 190, 192, 194, 347/195, 211, 215, 218; 400/120.01, 120.03, 400/120.12, 621

See application file for complete search history.

(56) References Cited

U.S. PATENT DOCUMENTS

| | | | | |
|---|---|---|---|---|
| 4,184,063 | A | 1/1980 | Heiling et al. | |
| 5,831,656 | A | 11/1998 | Chosa | |
| 5,964,541 | A | 10/1999 | Murison et al. | |
| 6,518,991 | B2 | 2/2003 | Sasaki et al. | |
| 6,618,068 | B2 | 9/2003 | Ishikawa | |
| 6,784,908 | B2 * | 8/2004 | Shibuya | 347/192 |
| 7,304,658 | B2 * | 12/2007 | Naito et al. | 347/195 |
| 2001/0021331 | A1 | 9/2001 | Brewington et al. | |
| 2002/0001027 | A1 | 1/2002 | Sugioka et al. | |
| 2005/0162503 | A1 * | 7/2005 | Jung et al. | 347/175 |

FOREIGN PATENT DOCUMENTS

| | | |
|---|---|---|
| EP | 0 981 246 | 2/2000 |
| EP | 1 321 296 | 6/2003 |
| JP | 04-132289 | 5/1992 |
| JP | 2001-310503 | 11/2001 |
| JP | 2002-342717 | 11/2002 |
| JP | 2004-042404 | 2/2004 |
| JP | 2004-106389 | 4/2004 |
| KR | 1019980060320 | 10/1998 |
| KR | 1019990055077 | 7/1999 |
| KR | 100252112 | 1/2000 |
| KR | 1020040035432 A | 4/2004 |

* cited by examiner

*Primary Examiner*—K. Feggins
(74) *Attorney, Agent, or Firm*—Roylance, Abrams, Berdo & Goodman LLP

(57) ABSTRACT

A thermal printer having an improved arrangement of memory card sockets on a main board and capable of printing an image on a print medium by applying heat to both surfaces of the print medium is provided. The thermal printer includes: a rotating unit rotatably installed within a frame and including a recording head and a support member; a main board installed on the frame and connected to the recording head via a cable, applying power to and providing image data to the recording head; and a memory card socket into and from which a memory card providing the image data is inserted and removed, the memory card mounted on the main board. The recording head forms an image on the print medium by heating a surface or an opposite surface of the print medium according to a location to which the recording head is rotated. The support member is installed opposite to the recording head and supports the print medium. The image data provided from the memory card can be printed.

20 Claims, 4 Drawing Sheets

THERMAL PRINTER

CROSS-REFERENCE TO RELATED APPLICATIONS

This application claims the benefit under 35 U.S.C. § 119(a) of Korean Patent Application No. 10-2004-0090139, filed on Nov. 6, 2004, in the Korean Intellectual Property Office, the entire disclosure of which is hereby incorporated by reference.

BACKGROUND OF THE INVENTION

1. Field of the Invention

The present invention relates to a thermal printer which forms an image by heating both surfaces of a print medium. More particularly, the present invention relates to a thermal printer which performs printing without being connected to a computer by mounting a memory card socket on a main board and is compact due to an optimal arrangement of the memory card socket on the main board.

2. Description of the Related Art

Thermal printers print an image on a thermal imaging print medium by applying heat to the print medium with a recording head. The print medium reveals an image of a selected color depending on the heating temperature and the period of time that heat is applied. Thermal print medium is different from paper, which is typically used as a print medium, and has a structure as illustrated in FIG. 1.

Referring to FIG. 1, the thermal print medium includes a transparent substrate 1. A first image forming layer 2, a spacer 3, a second image forming layer 4, and an upper protective layer 5 are sequentially stacked on an upper surface of the transparent substrate 1. A third image forming layer 6, a reflective layer 7, and a lower protective layer 8 are sequentially stacked on a lower surface of the transparent substrate 1.

The first, second, and third image forming layers 2, 4, and 6 represent different colors and comprise yellow, magenta, and cyan leuco dyes, respectively, and a developer. The spacer 3 separates the first and second image forming layers 2 and 4 and is transparent so that the colors produced in the first and second forming layers 2 and 4 can be viewed from the side of the upper protection layer 5 opposite to the second forming layer 4. The colors in the first, second, and third image forming layers 2, 4, and 6 respond to different heating temperatures and heating times.

To form an image on a print medium having such a structure, a conventional thermal printer has a structure as illustrated in FIG. 2. Referring to FIG. 2, the conventional thermal printer includes a transfer unit 10 for transferring a print medium M, first and second recording heads 21 and 25 disposed on both surfaces of the print medium, respectively, and first and second support units 31 and 35 disposed to face the first and second recording heads 21 and 25, respectively. The first and second recording heads 21 and 25 are electrically connected to a main board 40 to receive power and image data from the main board 40.

As described above, the conventional thermal printer forms a color image on the print medium M using the two fixed recording heads 21 and 25. In this case, the recording heads 21 and 25 can be easily connected to the main board 40 using cables 41 and connectors 45. However, the use of two recording heads 21 and 25 complicates the structure of the thermal printer and increases the manufacturing costs of the thermal printer.

Furthermore, thermal printers should be capable of being used not only as an output device for a computer, but also should be capable of being directly or indirectly connected to various types of apparatuses capable of providing image data, such as, digital cameras, portable digital assistants (PDAs), cellular phones with built-in digital cameras, and the like. The thermal printers should receive image data from these apparatuses and print an image corresponding to the image data. Moreover, the thermal printer should be compact so that it can be carried.

Accordingly, there is also a need for an improved, compact thermal printer which is capable of being connected to various types of apparatuses, and which is capable of forming an image on both surfaces of a print medium by using a single movable recording head.

SUMMARY OF THE INVENTION

An aspect of the present invention is to solve at least the above problems and/or disadvantages and to provide at least the advantages described below. Accordingly, an aspect of the present invention is to provide a compact thermal printer which has a single recording head that prints images on both surfaces of a print medium.

Another aspect of the present invention is to provide a thermal printer that is capable of printing image data received from an external apparatus by connecting the thermal printer to the external apparatus using mounting sockets. Preferably, the sockets are disposed on a main board to reduce the size of the thermal printer.

According to an aspect of the present invention, a thermal printer includes a rotating unit, a main board, and a memory card socket. The rotating unit is rotatably installed within a frame and includes a recording head forming an image on a print medium by heating a surface or an opposite surface of the print medium according to a location to which the recording head is rotated, and a support member installed opposite to the recording head, supporting the print medium. The main board is installed on the frame and connected to the recording head via a cable. The main board supplies power and image data to the recording head. A memory card providing the image data is inserted into and removed from the memory card socket, which is mounted on the main board. The image data provided from the memory card can be printed.

According to another aspect of the present invention, a thermal printer includes a recording head that is rotatably installed within a frame. The recording head forms an image on a print medium by heating a surface or an opposite surface of the print medium according to a location to which the recording head is rotated. A platen roller is installed opposite to the recording head and forms a nip for receiving the print medium. A support bracket rotates the recording head about a rotating shaft of the platen roller. A driving source provides a rotating force to the support bracket. A main board is installed on the frame and supplies power and image data to the recording head. A flexible cable is disposed on one or both sides of the print medium in such a manner that it does not disturb transfer of the print medium and reciprocation of the recording head. The flexible cable connects the main board to the recording head. A memory card socket into which a memory card providing image data is inserted and removed is mounted on the main board. A universal serial bus (USB) connector is installed on the main board and connected to an external host or an external device.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

A thermal printer according to an embodiment of the present invention is designed to form an image on a thermal imaging print medium by heating both surfaces of the thermal imaging print medium using a single recording head. This thermal printer has a structure illustrated in FIGS. 3 through 5.

Figure 3:
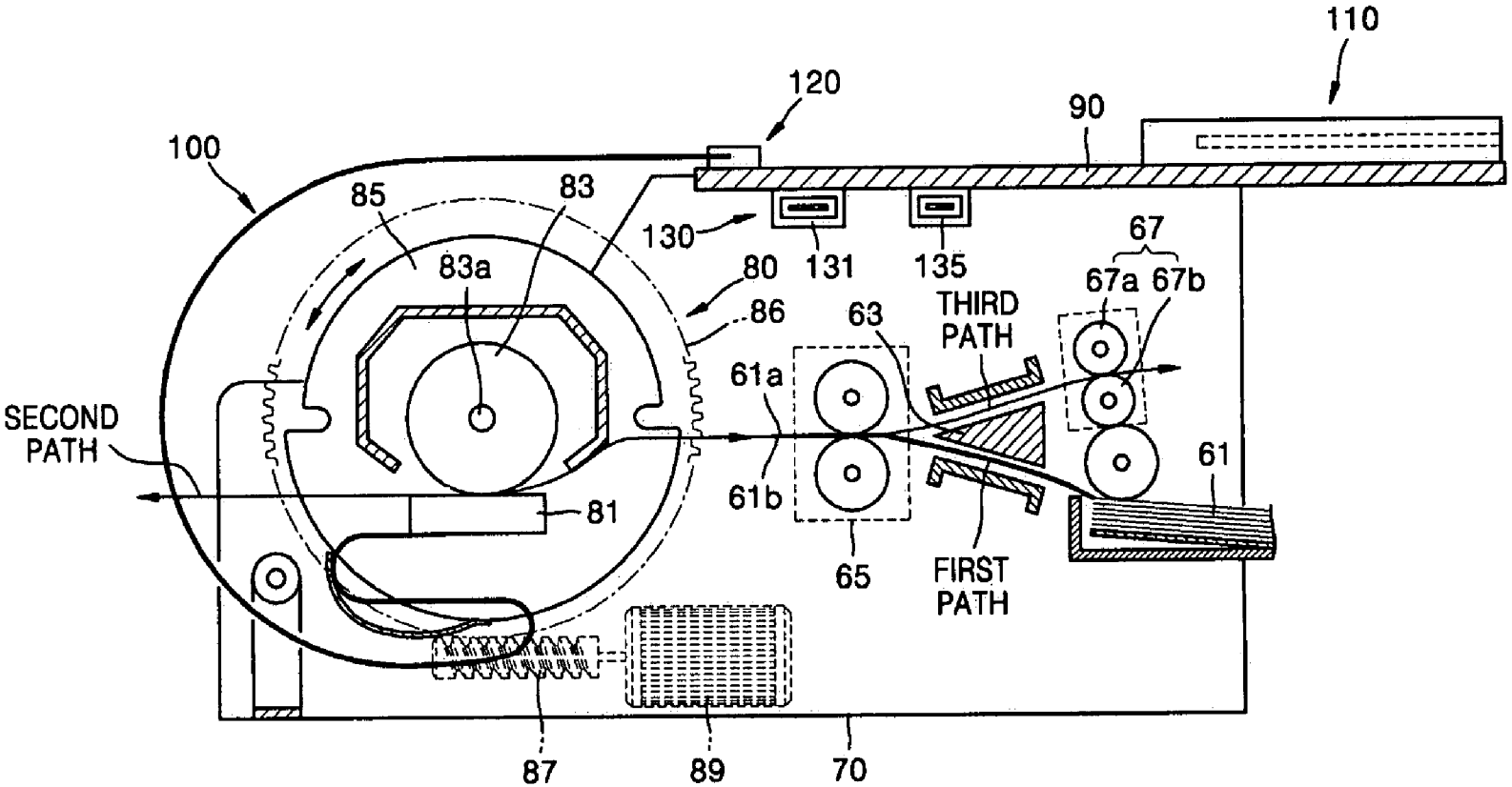
FIG. 3 is a schematic cross-section of a thermal printer according to an embodiment of the present invention when the printer is printing on a second surface of a print medium.
Figure 4:
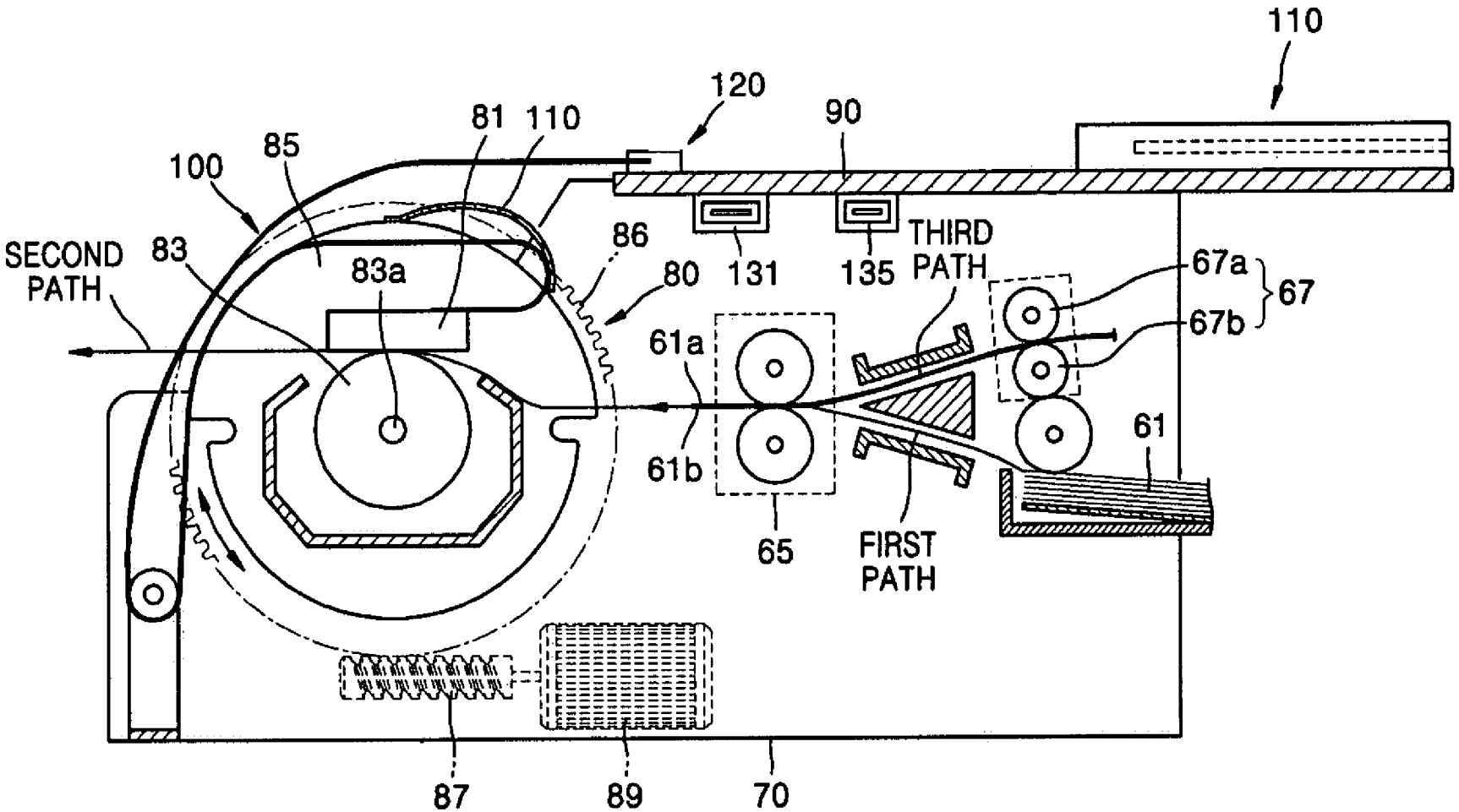
FIG. 4 is a schematic cross-section of the thermal printer shown in FIG. 3 when the printer is printing on a first surface of a print medium.
Figure 5:
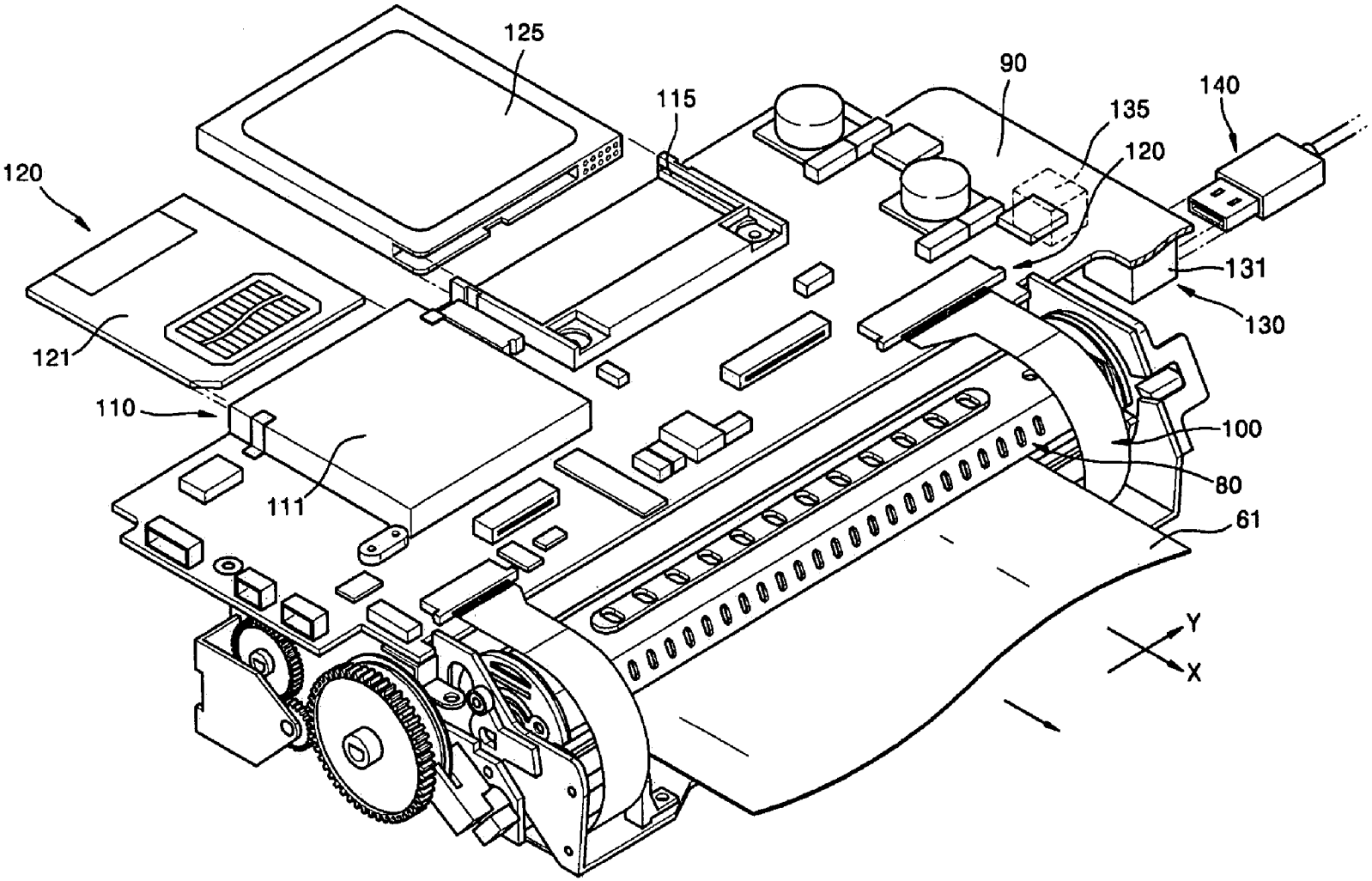
FIG. 5 is a perspective view of the thermal printer illustrated in FIGS. 3 and 4.

Referring to FIGS. 3 through 5, the thermal printer includes a rotating unit 80, a main board 90, and a memory card socket 110. The rotating unit 80 is rotatably installed within a frame 70. The main board 90 is fixed onto the frame 70 and connected to the rotating unit 80 through a cable 100. The memory card socket 110 is mounted on the main board 90.

Figure 1:
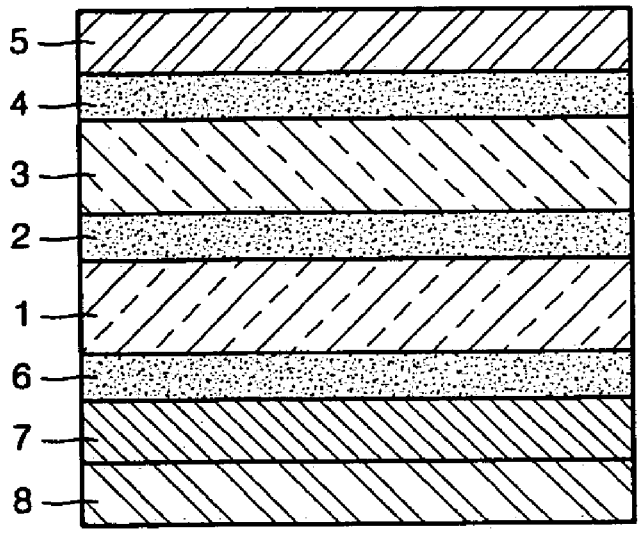
FIG. 1 is a schematic cross-section of a thermal imaging print medium.
Figure 2:
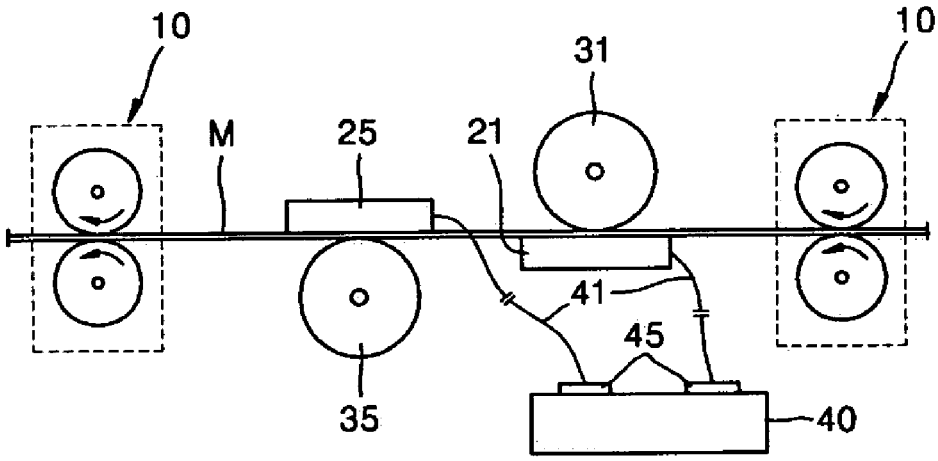
FIG. 2 (PRIOR ART)
FIG. 2 is a schematic cross-section of a conventional thermal printer.

A print medium such as the print medium illustrated in FIG. 1 may be used as a print medium 61. An image is formed on the print medium 61 by applying heat to first and second surfaces 61*a* and 61*b* of the print medium 61. The print medium 61 is disposed so that the first and second surfaces 61*a* and 61*b* can move forward and backward along first through third paths without being turned upside down while being transferred within the thermal printer. The print medium may be any suitable type of thermal imaging print media on which double-sided printing is possible, and is not limited to the print medium 61 shown in FIG. 1.

The first path is a supply path along which the print medium 61 is transferred to the second path. The second path is where the print medium 61 is printed with an image. The third path is a path along which the print medium 61 travels while printing or is finally discharged from when completely printed. A print medium guide 63, for guiding the print medium 61, and a transfer unit 65 are disposed between the first and third paths. The print medium guide 63 guides the print medium 61 supplied along the first path to the second path. During printing, the print medium guide 63 guides the print medium 61 from the second path to the third path. The transfer unit 65 transfers the print medium 61 from the first path to the second path, from the second path to the third path, or from the third path to the second path according to the stage of printing. A discharge unit 67, including a discharge roller 67*a* and an idle roller 67*b* engaged with the discharge roller 67*a*, is disposed along the third path to discharge the print medium 61.

The rotating unit 80 includes a recording head 81 and a support member 83. The recording head 81 forms an image on the print medium 61 by heating the print medium 61. The support member 83 is installed opposite to the recording head 81 to support the print medium 61 so that the print medium 61 can thermally contact the recording head 81 during image formation.

The recording head 81 is a thermal recording head, such as, a thermal print head (TPH), and is rotatably installed within the frame 70. The recording head 81 forms an image by heating the first or second surface 61*a* or 61*b* of the print medium 61 according to the location to which the recording head 81 is rotated. More specifically, when the recording head 81 is located at the position illustrated in FIG. 3, an image is formed on the second surface 61*b* of the print medium 61. When the recording head 81 is located at the position illustrated in FIG. 4, an image is formed on the first surface 61*b* of the print medium 61.

The support member 83 may be a platen roller as illustrated in FIGS. 3 and 4 and forms a nip for receiving the print medium 61.

In this embodiment, the recording head 81 is rotated about a rotating shaft 83*a* of the support member 83 and faces either the first or second surface 61*a* or 61*b* of the print medium 61 according to the location to which the recording head 81 is rotated. To rotate the recording head 81 about the rotating shaft 83*a* of the support member 83, the rotating unit 80 includes a support bracket 85 for supporting the recording head 81 and a driving source for rotating the support bracket 85. The driving source includes a gear portion 86, a driving motor 89, and a worm gear 87. The gear portion 86 is installed around an outer circumference of the support bracket 85. The worm gear 87 transmits power of the driving motor 89 to the gear portion 86. The rotating unit 80 is rotated when the print medium 61 is not present in the second path. In other words, the rotating unit 80 is rotated before the print medium 61 is supplied from the first path to the second path or when the first surface 61*a* of the print medium 61 has been printed with an image but has not yet been returned to the second path after being transferred to the third path.

The main board 90 is fixed onto the frame 70 in a manner that minimizes the size of the thermal printer. The main board 90 supplies power to and provides image data to the recording head 81 via the cable 100. The cable 100 is disposed on one or both sides of the print medium 61 and connects the main board 90 to the recording head 81. The cable 100 may be a flexible cable that can deform or return to its original shape according to a location to which the recording head 81 is rotated, for example, a flexible printed cable (FPC) having a pattern-shaped wire structure.

The memory card socket 110, into which the memory card 120 (that provides image data) is attached or detached, is mounted on the main board 90. As described above, when the memory card socket 110 is mounted on the main board 90, an image corresponding to image information received from the memory card 120 can be printed. In other words, the thermal printer is not only used as an output device for a computer, but can also print an image corresponding to information obtained from digital apparatuses (such as digital cameras, PDAs, cellular phones, or the like) and stored in the memory card 120, without any help from a computer.

As seen in FIG. 5, the memory card socket 110 includes first and second memory card sockets 111 and 115 having different physical specifications. A memory card 121 having a first physical specification, such as, a smart media card, an XD card, an SD card, an MMC card, a memory stick, or the like, is inserted into or removed out of the first memory card socket 111. The first memory card socket 111 has a specification that enables an interface with these memory cards. The second memory card socket 115 has a specification that enables an interface with a memory card 125 having a second physical specification, such as, a CompactFlash (CF) card (Type I), a CF card (Type II), or the like.

The first and second memory card sockets 111 and 115 are disposed on the main board 90 to be adjacent to each other in the width direction Y of the main board 90, which is perpendicular to the traveling direction X of the print medium 61. The reason why the first and second memory card sockets 111 and 115 are disposed in the width direction Y of the main board 90 is to minimize the increase of a length of the thermal printer in the X direction even when the first and second memory card sockets I 11 and 115 are mounted on the main board 90. The increase in length in the X direction is minimized because the width of the main board 90 in the width direction Y is quite long, since the width of the print medium 61 is relatively wide.

In other words, if the memory cards 121 and 125 have widths of 37 mm and 42.8 mm maximum, respectively, the entire width of the first and second memory card sockets 111 and 115 is at least 79.8 mm. Hence, if the first and second memory card sockets 111 and 115 are disposed in the X direction of the length of the main board 90 instead of in the width direction Y of the main board 90, the length of the main board 90 in the X direction needs to be at least 79.8 mm. This arrangement hinders the minimization of the thermal printer. On the other hand, if the first and second memory card sockets 111 and 115 are disposed in the width direction Y of the main board 90, the length of the main board 90 in the X direction can be less than 79.8 mm.

Preferably, the thermal printer further includes a universal serial bus (USB) connector 130 installed on the main board 90. The USB connector 130 includes a USB host connector 131 and a USB device connector 135 and is connected to a computer, a digital camera, or the like via a USB cable 140 to transmit and receive image data.

Preferably, the USB host connector 131 and the USB device connector 135 are disposed on one side of the main board 90 to be adjacent to each other in the traveling direction X of the print medium 61. This disposition maximizes the utilization of the space of the main board 90. In other words, because the USB connector 130 has a width of about 13 mm which is relatively smaller than the memory card socket 110, the aforementioned disposition of the USB host connector 131 and the USB device connector 135 does not greatly affect the length of the main board 90, and also does not interfere with the insertion and removal of the memory card 120 into and from the memory card socket 110.

The thermal printer having the above-described a structure includes a single recording head to form an image on both surfaces of a print medium, and, thus, the thermal printer is compact.

In addition, the inclusion of a memory card socket capable of being connected directly or indirectly to an external apparatus enables image data received from the external apparatus to be printed. Furthermore, since first and second memory card sockets are arranged in a width direction of the main board and a USB connector is disposed on one side of the main board, the space of the main board is fully utilized, and the thermal printer is compact.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal printer comprising:

a rotating unit rotatably installed within a frame, the rotating unit comprising a recording head forming an image on a print medium by heating a surface or an opposite surface of the print medium according to a location to which the recording head is rotated; and a support member installed opposite to the recording head, supporting the print medium;

a main board installed on the frame and connected to the recording head via a cable, the main board supplying power to and providing image data to the recording head; and a memory card socket into which a memory card providing image data is inserted and removed, the memory card socket being mounted on the main board, wherein the image data provided from the memory card can be printed.

2. The thermal printer of claim 1, wherein the memory card socket comprises a first memory card socket and a second memory card socket having different physical specifications.

3. The thermal printer of claim 2, wherein the first and second memory card sockets are disposed adjacent to each other in a direction orthogonal to a traveling direction of the print medium.

4. The thermal printer of claim 2, wherein the first memory card socket has a specification that enables an interface with a smart media card, an XD card, an SD card, an MMC card, and a memory stick.

5. The thermal printer of claim 2, wherein the second memory card socket has a specification that enables an interface with a Compact Flash (CF) card (Type I) and a CF card (Type II).

6. The thermal printer of claim 1, further comprising:

a universal serial bus (USB) connector installed on the main board.

7. The thermal printer of claim 6, wherein the USB connector comprises a USB host connector and a USB device connector which are disposed on one side of the main board to be adjacent to each other in a traveling direction of the print medium.

8. The thermal printer of claim 1, wherein:

the cable is disposed on one or both sides of the print medium and connects the main board to the recording head; and the cable is a flexible cable that can deform or return to the original shape according to a location to which the recording head is rotated.

9. A thermal printer comprising:

a recording head rotatably installed within a frame, the recording head forming an image on a print medium by heating a surface or an opposite surface of the print medium according to a location to which the recording head is rotated;

a platen roller installed opposite to the recording head, the platen roller forming a nip for receiving the print medium;

a support bracket rotating the recording head about a rotating shaft of the platen roller;

a driving source providing a rotating force to the support bracket;

a main board installed on the frame, the main board supplying power to and providing image data to the recording head;

a flexible cable disposed on one or both sides of the print medium without disturbing transfer of the print medium and reciprocation of the recording head, the flexible cable connecting the main board to the recording head;

a memory card socket which a memory card providing the image data is inserted and removed, the memory card socket being mounted on the main board; and a universal serial bus (USB) connector installed on the main board, the USB connector being capable of being connected to an external host or an external device.

10. The thermal printer of claim 9, wherein the memory card socket comprises a first memory card socket and a second memory card socket having different physical specifications.

11. The thermal printer of claim 10, wherein the first and second memory card sockets are disposed adjacent to each other in a direction orthogonal to a traveling direction of the print medium.

12. The thermal printer of claim 10, wherein the first memory card socket has a specification that enables an interface with a smart media card, an XD card, an SD card, an MMC card, and a memory stick.

13. The thermal printer of claim 10, wherein the second memory card socket has a specification that enables an interface with a Compact Flash (CF) card (Type I) and a CF card (Type II).

14. The thermal printer of claim 9, wherein the USB connector comprises a USB host connector and a USB device connector which are disposed on one side of the main board to be adjacent to each other in a traveling direction of the print medium.

15. A thermal printer for printing on first and second surfaces of a print medium that travels in a traveling direction, comprising:

a thermal recording head installed within a frame, the thermal recording head being movable between a first position for forming an image on the first surface of the print medium and a second position for forming an image on the second surface of the print medium;

a main board installed on the frame, the main board supplying power to and providing image data to the thermal recording head;

a flexible cable connecting the main board to the recording head;

a first memory card socket for receiving a memory card mounted on the main board; and a second memory card socket for receiving a memory card mounted on the main board, the first and second memory card sockets being disposed adjacent to each other in a direction orthogonal to the traveling direction of the print medium.

16. The thermal printer of claim 15, wherein the first and second memory card socket have different physical specifications.

17. The thermal printer of claim 16, wherein the first memory card socket has a specification that enables an interface with a smart media card, an XD card, an SD card, an MMC card, and a memory stick.

18. The thermal printer of claim 17, wherein the second memory card socket has a specification that enables an interface with a Compact Flash (CF) card (Type I) and a CF card (Type II).

19. The thermal printer of claim 15, further comprising:

a universal serial bus (USB) connector installed on the main board, the USB connector being capable of being connected to an external host or an external device.

20. The thermal printer of claim 19, wherein the USB connector comprises a USB host connector and a USB device connector which are disposed on one side of the main board to be adjacent to each other in the traveling direction of the print medium.

* * * * *